US011913688B2

(12) United States Patent
Zuniga Mangas et al.

(10) Patent No.: US 11,913,688 B2
(45) Date of Patent: Feb. 27, 2024

(54) MECHANICAL REFRIGERATION SYSTEM

(71) Applicant: Off Technologies stp, S.L., Madrid (ES)

(72) Inventors: Luis Zuniga Mangas, Madrid (ES); Angel Gabriel Ramos Ramos, Madrid (ES)

(73) Assignee: OFF TECHNOLOGIES STP, S.L., Madrid (ES)

( * ) Notice: Subject to any disclaimer, the term of this patent is extended or adjusted under 35 U.S.C. 154(b) by 532 days.

(21) Appl. No.: 17/262,440

(22) PCT Filed: Mar. 8, 2019

(86) PCT No.: PCT/ES2019/070154
§ 371 (c)(1),
(2) Date: Jan. 22, 2021

(87) PCT Pub. No.: WO2020/021134
PCT Pub. Date: Jan. 30, 2020

(65) Prior Publication Data

US 2021/0293458 A1 Sep. 23, 2021

(30) Foreign Application Priority Data

Jul. 22, 2018 (ES) ..... ES201830743

(51) Int. Cl.
*F25B 31/02* (2006.01)
*F04B 5/02* (2006.01)
(Continued)

(52) U.S. Cl.
CPC ..... *F25B 31/023* (2013.01); *F04B 5/02* (2013.01); *F04B 9/105* (2013.01); *F04B 9/109* (2013.01);
(Continued)

(58) Field of Classification Search
CPC ..... F25B 31/023; F04B 5/02; F04B 9/105; F04B 9/109; F04B 9/113; F04B 9/131; F04B 31/00; F04B 35/008
See application file for complete search history.

(56) References Cited

U.S. PATENT DOCUMENTS 3,249,289 A 5/1966 Maglott
3,775,028 A 11/1973 Davis
(Continued)

FOREIGN PATENT DOCUMENTS

CA 2644346 5/2010
DE 102011080377 A1 2/2013
(Continued)

*Primary Examiner* — Joseph F Trpisovsky
(74) *Attorney, Agent, or Firm* — Hayes Soloway PC

(57) ABSTRACT

Mechanical refrigeration system includes a compression device. The compression device has a pair of dual-action cylinders connected together by a movable rod thereof. A first cylinder acts as an element for compressing coolant fluid, for which purpose the rod is moved through the second cylinder, fed by a pressurised fluid that allows the flow of coolant fluid in the first cylinder and the flow of pressurised fluid of the second cylinder at the outlet of both devices to be constant, thus configuring a completely autonomous device that does not need electricity or any type of fuel.

6 Claims, 4 Drawing Sheets

(51) Int. Cl.

| | |
|---|---|
| ***F04B 9/105*** | (2006.01) |
| ***F04B 9/109*** | (2006.01) |
| ***F04B 9/113*** | (2006.01) |
| ***F04B 9/131*** | (2006.01) |
| ***F04B 31/00*** | (2006.01) |
| ***F04B 35/00*** | (2006.01) |

(52) U.S. Cl.
CPC ..... *F04B 9/113* (2013.01); *F04B 9/131* (2013.01); *F04B 31/00* (2013.01); *F04B 35/008* (2013.01)

(56) References Cited

U.S. PATENT DOCUMENTS

| | | | | |
|---|---|---|---|---|
| 3,823,573 | A | 7/1974 | Cassady | |
| 4,761,118 | A | 8/1988 | Zanarini | |
| 4,779,427 | A | 10/1988 | Rowley et al. | |
| 5,564,912 | A | 10/1996 | Peck et al. | |
| 6,915,656 | B2 * | 7/2005 | Ratliff ..... | F25B 1/10 62/238.7 |
| 2004/0231507 | A1 | 11/2004 | Miyashita et al. | |
| 2015/0211370 | A1 | 7/2015 | Rice | |

FOREIGN PATENT DOCUMENTS

| | | |
|---|---|---|
| FR | 2453999 | 11/1980 |
| GB | 456232 | 11/1936 |
| WO | 2004011155 A1 | 2/2004 |

* cited by examiner

MECHANICAL REFRIGERATION SYSTEM

CROSS-REFERENCE TO RELATED APPLICATIONS AND PRIORITY

This patent application claims priority from PCT Patent Application No. PCT/ES2019/070154 filed Mar. 8, 2019, which claims priority from Spanish Patent Application No. P201830743 filed Jul. 22, 2018. Each of these patent applications are herein incorporated by reference in their entirety.

DESCRIPTION

Object of the Invention

The present invention relates to a mechanical refrigeration system, that is, not requiring electrical energy or any type of fuel to operate, making it especially applicable in places where there is no electrical light, or where it is simply desirable to have a completely autonomous refrigeration system, which requires only a pressurised water flow to operate.

BACKGROUND OF THE INVENTION

There are countless known refrigeration systems based on a closed circuit, through which there circulates a fluid, which is compressed, thereby increasing its temperature. Said fluid is then made to pass through a capacitor by means of which part of the heat generated in said compression process is extracted, such that, at the outlet of said capacitor, there is established an expansion valve after which the fluid loses pressure, causing it to evaporate. In this process, the gas is cooled, and said process is carried out in a coil acting as an evaporator, after which it is possible to refrigerate a cold chamber, cool the air of an air condition equipment, etc.

Devices/systems of this type present a drawback in respect of which the following aspects should be mentioned:

They utilise electric compressors, which involves a clearly undesirable dependence on electricity.

The type of compressors used include motors that become heated, which has a negative impact on the performance of the system.

In an attempt to improve the performance of these systems, refrigeration systems based on absorption cycles, that is, on the capacity which some substances have to absorb, in liquid phase, vapours of other substances, are known. These are therefore two-component systems, where one of the substances is dissolved in the other substance, and cooling takes place by extracting one of the two substances of the solution by means of applying heat and then reabsorbing it in the solution.

With respect to conventional compression systems, absorption refrigeration systems have the advantage that they have a lower electricity demand, although said demand is replaced by a thermal demand.

In any event, systems of this type have very high manufacturing costs and they are also very limited with respect to the minimum temperatures that such systems can achieve.

Another way to obtain a refrigeration system is described in document WO 2004/11155, wherein a reciprocating compressor is utilised, said reciprocating compressor being formed by a cylinder with a piston associated with a refrigeration circuit and said cylinder in turn being actuated by another power cylinder, such that both cylinders are interconnected together by a common rod.

While it is possible to obtain in this manner a mechanical compressor, the fact is that the device described in this document envisages an extremely complex actuation system for the power cylinder, which includes a boiler, electronic components, as well as a large amount of ducting and impulse pumps which have a very negative impact on the device from the viewpoint of structural complexity, a dependence on fuels and also a dependence on electricity, which means that the refrigeration system cannot by any means be considered autonomous.

DESCRIPTION OF THE INVENTION

The proposed refrigeration system constitutes a structurally very simple mechanical actuation system that does not require electricity or fossil fuels, and is highly cost-effective, completely autonomous, and exhibits a better performance than that of conventional systems.

For that purpose, and based on the conventional structuring of a basic refrigeration system, in which there is defined a closed circuit for a coolant fluid, which includes a compressor device compressing said fluid, causing its temperature to increase, with said fluid being made to pass through a capacitor by means of which part of the heat generated in said compression process is extracted, such that at the outlet of said capacitor there is established an expansion valve after which the fluid loses pressure, causing it to evaporate, in which process the gas is cooled, and this cold is utilised for the corresponding application, with said fluid being recirculated back to the compressor device; the features of the invention relate to the special configuration of said compressor device, and more specifically its actuation means.

Having said that, more specifically the compressor device is materialised in a pair of dual-action cylinders connected together by means of the movable rod thereof.

Therefore, one of the dual-action cylinders will act at all times as a compression system for the refrigerant fluid, having at each of its two intakes, acting as both inlets and outlets, respective pairs of branches which, by means of check valves are connected in series to the conventional refrigeration circuit, such that said fluid exits the circuit compressed, through one branch or another, the opposite branch acting as an incoming fluid aspiration element.

In regard to the second dual-action cylinder, and according to the essence of the invention, for this cylinder to work in a reciprocating and constant manner, that is, for it to work when it moves it one direction and when it moves in the opposite direction, it has been envisaged that the two intakes connecting with the two chambers of this cylinder are connected to two branches, each of which has its respective opening/closing valves, there being two-by-two communication between opposite branches, at which communication point there is established a pressurised water inlet and water outlet, respectively.

Therefore, by controlling the valves of the branches, the pressurised water can be made to pass to one chamber or the other of the dual-action cylinder, meaning that while one chamber is filled with pressurised water, the other chamber is emptied and said water is recirculated towards the outlet of the system, with the process being inverted once the plunger reaches the limit of its stroke within the cylinder.

For this process to be carried out in a completely mechanical and automatic manner, the outer rod linking both dual-action cylinders will incorporate in its middle area an actuator with a limit switch that is synchronised with the means for opening and closing the valves of the branches associated with the pressurised water feed circuit of said second dual-action cylinder.

Therefore, by acting automatically on the opening and closing of the valves of the different branches, a constant flow of pressurised water from the inlet to the outlet thereof is achieved, which at all times causes the reciprocating movement in one direction or the other of the rod linking both cylinders, therefore causing a reciprocating compression process in either chamber of the first dual-action cylinder or compression cylinder, which is utilised to carry out the compression of the coolant fluid.

In regard to the supply of pressurised water for the system, it does not present any losses or any type of contamination of the water circulating therethrough, therefore it could be installed in series in any water supply pipe in which the water is always moving, with a pressure of about 2 $Kg/cm^2$ being sufficient to move the mechanism.

According to one embodiment variant of the invention, and for the purpose of the maximum autonomy possible for the system, it has been envisaged that the pressurised water feed system is materialised in a closed circuit, which is connected to the inlet and to the outlet of the mentioned supply branches and outlet of the system, such that in said closed circuit there are arranged in series a heat exchanger intended for cooling the water exiting the system, a check valve ensuring the circular and one-way flow of the water due to the pressure differential caused by the temperature differential, and a vacuum tube solar collector by means of which there is achieved a substantial increase in the water pressure at its outlet, which supplies the system in a closed circuit, as previously mentioned.

Since the means causing compression of the gas of the refrigeration circuit per se are independent, they do not have a negative impact on the temperature of said gas, as it is not heated due to friction, therefore the performance of installations of this type will be much higher than conventional installations.

In summary, the invention relates to a mechanical refrigeration system comprising:

a closed circuit for a coolant fluid, comprising:

a compressor device connected to a capacitor configured to extract part of the heat generated in the compressor device, the capacitor comprising an outlet, an expansion valve being disposed at the outlet of the capacitor configured to lower the pressure of the coolant fluid, an evaporator configured to evaporate the coolant fluid and generate cold, wherein the evaporator is communicated in a closed circuit with the compressor device, and wherein the compressor device is comprises a pair of dual-action cylinders, a first dual-action cylinder and a second dual-action cylinder, connected together by means of a movable rod thereof which is common for both dual-action cylinders, such that the first dual-action cylinder compresses the coolant fluid, having at each of its two intakes, acting as both inlets and outlets, respective pairs of branches which are connected in series to the closed circuit, and wherein the second dual-action cylinder comprises two intakes, corresponding to each of its two working chambers, each of which is connected to a branch in each of which there is established an opening/closing valve, that is, a first valve, a second valve, a third valve and a fourth valve, there being two-by-two communication between opposite branches, at which communication point there is established a pressurized water inlet and an outlet for said water, respectively, with the particularity that the opening and closing of the first valve and the third valve is mechanically synchronised, inversely with respect to the second valve and the fourth valve, there having been provided that in correspondence with the movable rod common to both dual-action cylinders there is established an actuator mechanically associated in limit switches thereof, the actuator comprising an inverter configured to invert the position of the opening/closing valves.

DESCRIPTION OF THE DRAWINGS

As a complement to the description that will be provided herein, and for the purpose of helping to make the features of the invention more readily understandable, according to a preferred practical exemplary embodiment thereof, said description is accompanied by a set of drawings constituting an integral part thereof in which, by way of illustration and not limitation, the following is represented.

PREFERRED EMBODIMENT OF THE INVENTION

Figure 1:
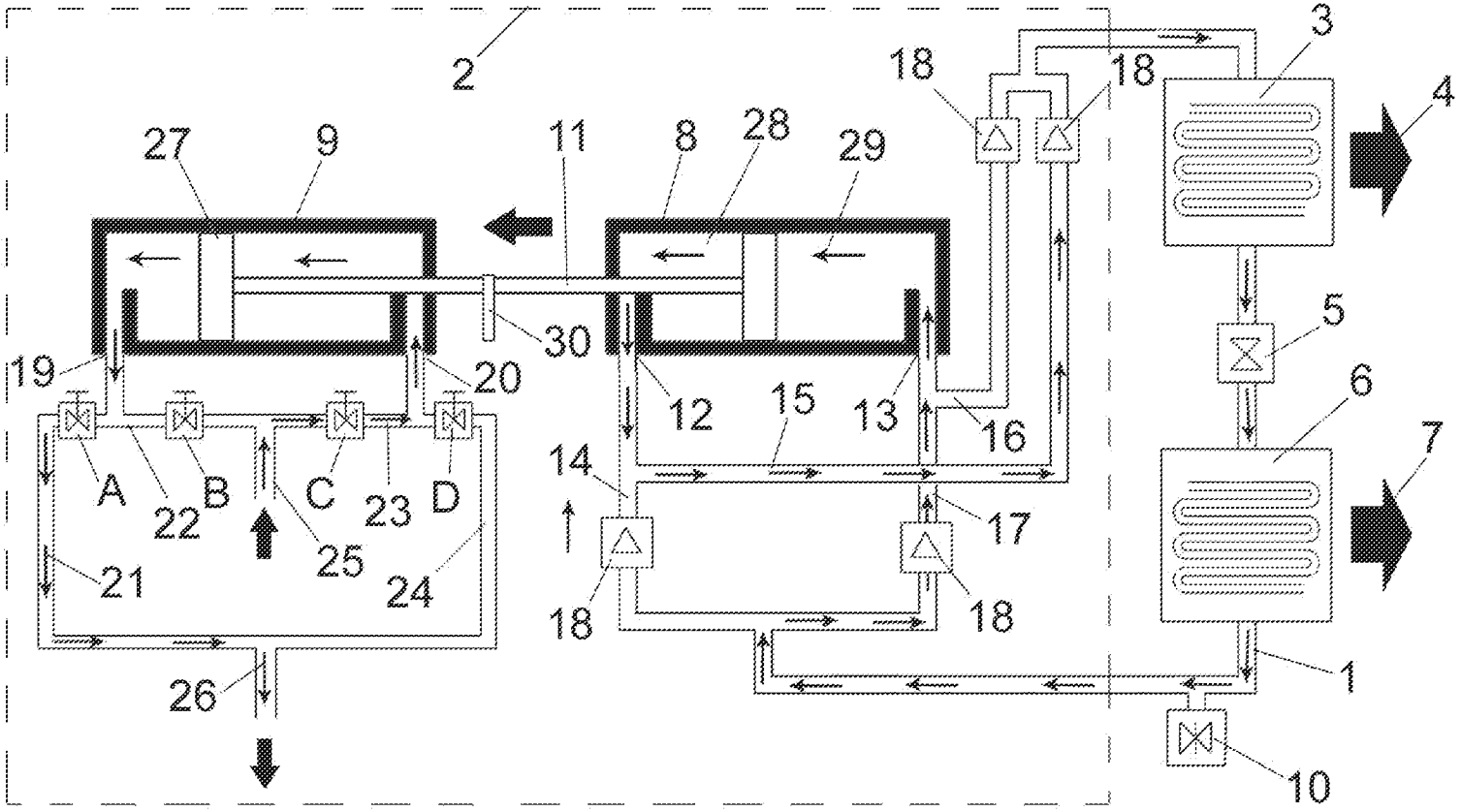
FIG. 1 shows a schematic view of a mechanical refrigeration system carried out according to the object of the present invention corresponding to the instant in which the rod common to both dual-action cylinders moves to the left.

In view of the mentioned figures, it can be observed how the system of the invention starts from a conventional structuring for a refrigeration system, wherein a closed circuit (1) for a coolant fluid is defined, which includes a compressor device (2), connected to a capacitor (3) by means of which part of the heat (4) generated in said compression process is extracted, there being established at the outlet of said capacitor (3) an expansion valve (5) after which the fluid loses pressure, causing it to evaporate in an evaporator (6), with a cold (7) being generated that is utilised for the application regarded as appropriate, which evaporator is communicated in a closed circuit with the compressor device (2), where said circuit may include the usually accessory elements, such as bleed valves (10), safety valves, etc.

In turn, the compressor device (2) is materialised in a pair of dual-action cylinders (8-9) connected together by means of the movable rod (11) thereof which is common for both.

Therefore, the first dual-action cylinder (8) acts as a compression system for the refrigerant fluid, having at each of its two intakes (12-13), acting as both inlets and outlets, respective pairs of branches (14-15), (16-17) which, by means of check valves (18), are connected in series to the main refrigeration circuit (1).

In turn, the second dual-action cylinder (9) is the one that does all the compression work that is carried out in the first cylinder (8).

More specifically and according to the essence of the invention, it has been envisaged that its two intakes (19-20) are connected to two branches (21-22) and (23-24) each of them having their respective opening/closing valves (A, B, C and D), there being two-by-two communication between opposite branches, at which communication point there is established a pressurised water inlet (25) and a water outlet (26).

Having said that, the opening and closing of valves (A) and (C) is mechanically synchronised, as occurs with valves (B) and (D), such that, according to FIG. 1, when valves (A) and (C) are open, and accordingly valves (B) and (D) are closed, the pressurised water causes movement of the plunger (27) to the left, which in turn causes the compression of the coolant gas in the sub-chamber (28) of the first dual-action cylinder (8), as well as a suction effect in the sub-chamber (29) of said cylinder (8).

Figure 2:
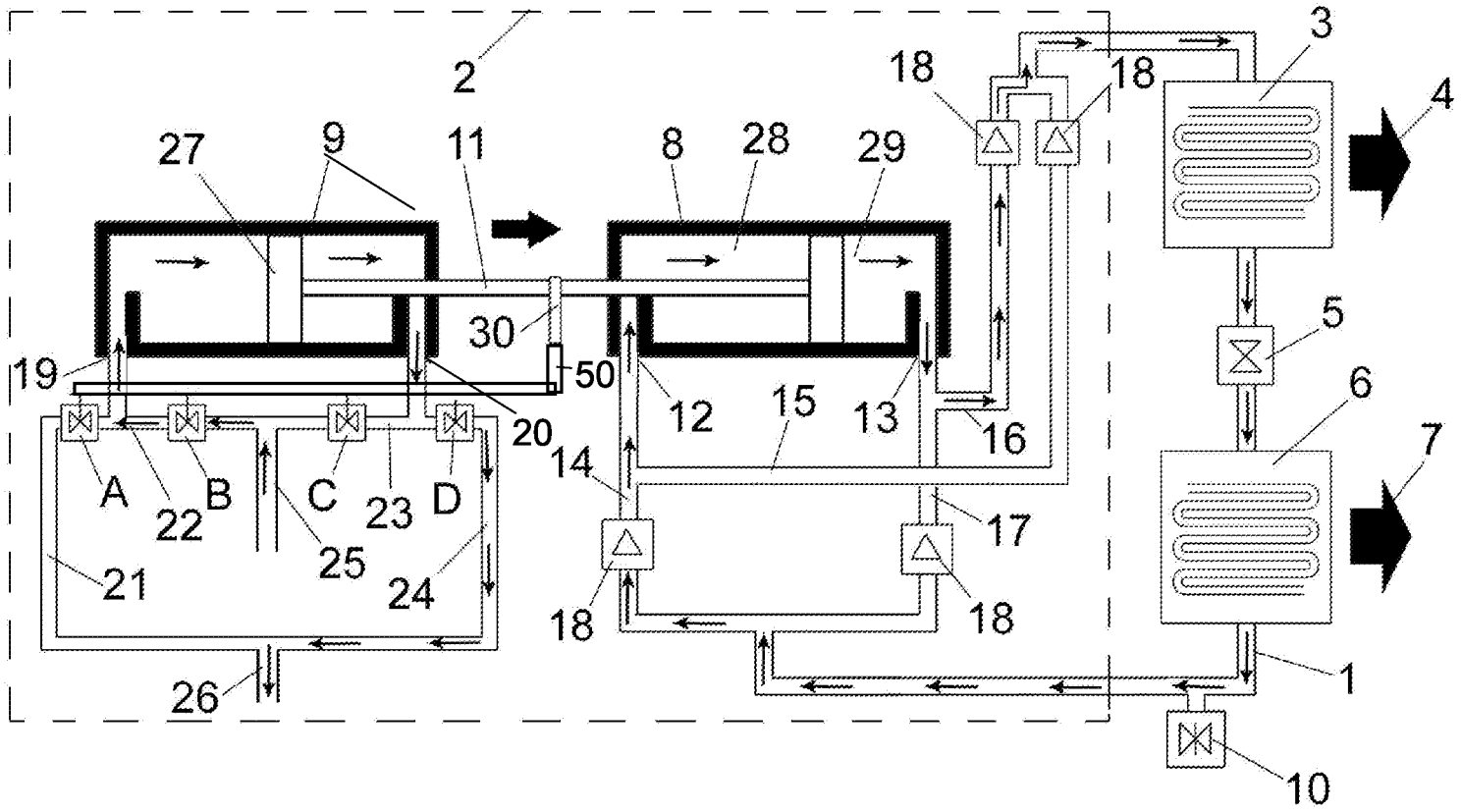
FIG. 2 shows a view similar to that of FIG. 1, but corresponding to the movement of the common rod to the right.

Conversely, when the plunger (27) reaches the limit of its stroke, by means of an actuator (30) comprising an inverter (50) configured to invert the position of the valves (A, B, C and D) with valves (A) and (C) being closed, and accordingly valves (B) and (D) open, as shown in FIG. 2, which will cause the pressurised water to cause the movement of the plunger (27) to the right, which in turn causes the compression of the coolant gas in the sub-chamber (29) of the first dual-action cylinder (8), as well as a suction effect in the sub-chamber (28) of said cylinder (8), such that the compressed gas in both cases would be conducted at all times to the capacitor (3).

By acting automatically on the opening and closing of the valves of the different branches, a constant flow of pressurised water from the inlet to the outlet thereof is achieved, which at all times causes the reciprocating movement in one direction or the other of the rod linking both cylinders, therefore causing a reciprocating compression process in either chamber (28-29) of the first dual-action cylinder (8), which is utilised to carry out the compression of the coolant fluid.

As discussed above, the system of the invention can be connected in series by means of its inlet (25) and its outlet (26) to any duct through which water circulates at sufficient pressure, with a pressure of about 2 $Kg/cm^2$ being sufficient.

Figure 3:
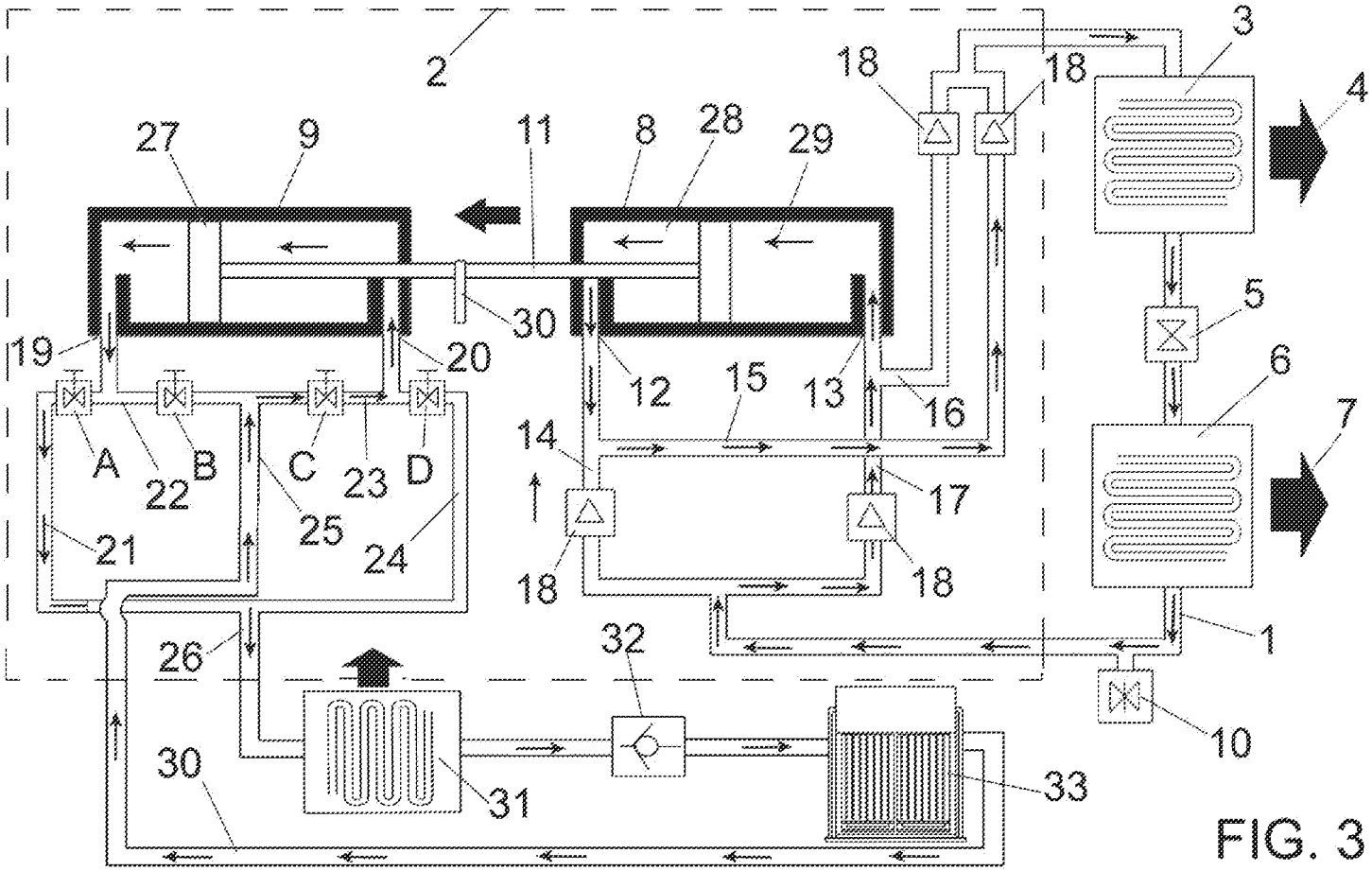
FIGS. 3 and 4 show respective views similar to FIGS. 1 and 2, but corresponding to a completely autonomous embodiment variant, in which an outer pressurised water intake is not required, because said pressurised water is provided in a closed circuit by a system based on a vacuum tube solar collector.
Figure 4:
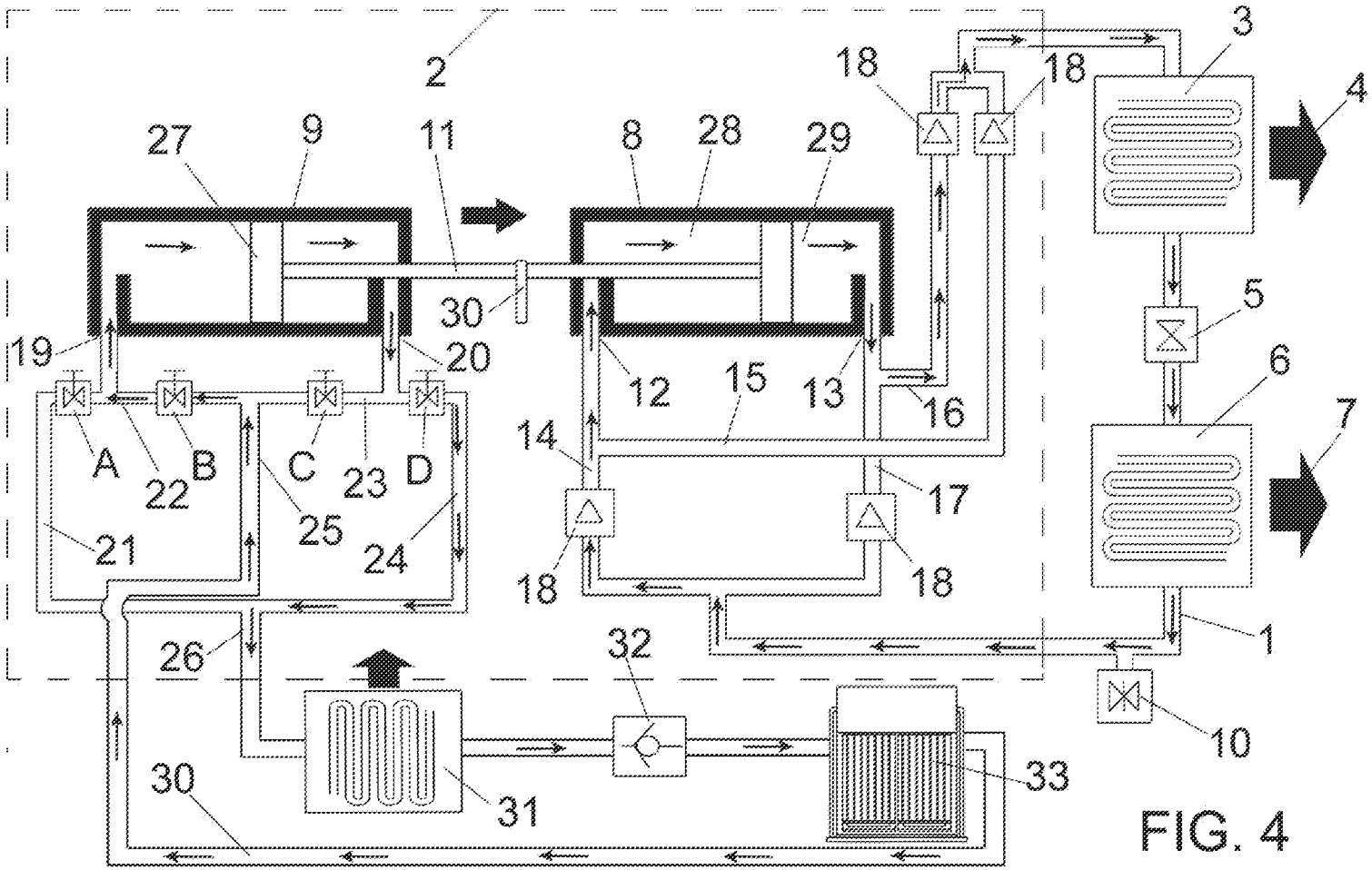

According to the embodiment variant of FIGS. 3 and 4, in order to obtain a completely autonomous system, that does not depend on any external source of pressurised water, it has been envisaged that the outlet (26) and the inlet (25) are connected in a closed loop (30) such that the outlet (26) is communicated with a heat exchanger (31), intended for cooling the water exiting the system and communicated by means of a check valve (32), so as to ensure the circular and one-way flow of the water, with a vacuum tube solar collector (33) by means of which there is achieved a substantial increase in the water pressure at its outlet, providing the system with complete autonomy.

As discussed above, it has experimentally been found that the system of the invention is capable of functioning with 2 $Kg/cm^2$ of water pressure, such that given that most vacuum tube solar collectors can provide water pressures of about 16 $Kg/cm^2$, the system could be multiplied as many times needed to take advantage of this excess pressure.

The invention claimed is:

1. Mechanical refrigeration system comprising:

a closed circuit for a coolant fluid, comprising:

a compressor device connected to a capacitor configured to extract part of the heat generated in the compressor device, the capacitor comprising an outlet, an expansion valve being disposed at the outlet of the capacitor configured to low the pressure of the coolant fluid, an evaporator configured to evaporate the coolant fluid and generate cold, wherein the evaporator is communicated in a closed circuit with the compressor device, and wherein the compressor device comprises a pair of dual-action cylinders, a first dual-action cylinder and a second dual-action cylinder, connected together by a movable rod thereof which is common for both dual-action cylinders, such that the first dual-action cylinder compresses the coolant fluid, and having at each of two intakes, acting as both inlets and outlets, respective pairs of branches which are connected in series to the closed circuit, and wherein the second dual-action cylinder comprises two intakes, corresponding to each of two working chambers, each of which is connected to a branch in each of which there is established an opening/closing valve that is a first valve, a second valve, a third valve and a fourth valve, there being two-by-two communication between opposite branches, at which communication point there is established a pressurized water inlet and an outlet for said water, respectively, with the particularity that the opening and closing of the first valve and the third valve is mechanically synchronised, inversely with respect to the second valve and the fourth valve, there having been provided that in correspondence with the movable rod common to both dual-action cylinders there is established an actuator mechanically associated in limit switches thereof, the actuator comprising an inverter configured to invert the position of the opening/closing valves.

2. The system of claim 1, wherein the water outlet and the water inlet are connected in a closed loop wherein there are established in series a heat exchanger after the water outlet, communicated by a check valve with a vacuum tube solar collector which feeds the water inlet.

3. The system of claim 1, further comprising a plunger movable in a first direction by the pressurized water, and wherein the first dual-action cylinder comprises a first sub-chamber and a second sub-chamber, wherein the pressurized water causes the compression of the coolant fluid in the first sub-chamber of the first dual-action cylinder, as well as a suction effect in the second sub-chamber of the first dual-action cylinder.

4. The system of claim 3, wherein the plunger is movable in a second direction by the pressurized water once the plunger reaches a stroke end, wherein the pressurized water causes the compression of the coolant fluid in the second sub-chamber of the first dual-action cylinder, as well as a suction effect in the first sub-chamber of the dual-action cylinder.

5. The system of claim 3 wherein the compressed coolant fluid is conducted to the capacitor.

6. The system of claim 4 wherein the compressed coolant fluid is conducted to the capacitor.

* * * * *